US006132179A

United States Patent [19]

Higashiyama

[11] Patent Number: 6,132,179

[45] Date of Patent: Oct. 17, 2000

[54] SCROLL TYPE COMPRESSOR ENABLING A SOFT START WITH A SIMPLE STRUCTURE

[75] Inventor: Akiyoshi Higashiyama, Gunma, Japan

[73] Assignee: Sanden Corporation, Gunma, Japan

[21] Appl. No.: 09/141,411

[22] Filed: Aug. 27, 1998

[30] Foreign Application Priority Data

Sep. 9, 1997 [JP] Japan ..... 9-244133

[51] Int. Cl.[7] ..... F04B 49/00

[52] U.S. Cl. ..... 417/310; 417/308

[58] Field of Search ..... 417/310, 299, 417/308

[56] References Cited

U.S. PATENT DOCUMENTS

| | | | |
|---|---|---|---|
| 4,940,395 | 7/1990 | Yamamoto | 417/310 |
| 5,049,044 | 9/1991 | Hirano | 417/310 |
| 5,074,761 | 12/1991 | Hirooka et al. | 417/310 |
| 5,639,225 | 6/1997 | Matsuda et al. | 417/299 |

FOREIGN PATENT DOCUMENTS

| | | |
|---|---|---|
| 52-17395 | 12/1982 | Japan . |
| 61-135052 | 6/1986 | Japan . |
| 152592 | 9/1989 | Japan . |

*Primary Examiner*—Henry C. Yuen
*Assistant Examiner*—Mahmoud M Gimie
*Attorney, Agent, or Firm*—Baker Botts L.L.P.

[57] ABSTRACT

A compressor has a compressor housing (10) which includes therein a fixed scroll (25) having a fixed plate member (51) and a fixed spiral member (52) provided on the fixed plate member, and a movable scroll (26) having a movable plate member (61) and a movable spiral member (62) provided on the movable plate member. The fixed plate member is provided with a plurality of bypass holes (51*a*, 51*b*) for allowing gas introduced into fluid pockets defined between the fixed and movable spiral members to escape at different positions. The fixed plate member is further provided with a plurality of valve mechanisms each corresponding to one of the plurality of bypass holes for opening or closing the corresponding bypass hole. Operating pressures of the valve mechanisms are set different from each other.

9 Claims, 6 Drawing Sheets

SCROLL TYPE COMPRESSOR ENABLING A SOFT START WITH A SIMPLE STRUCTURE

BACKGROUND OF THE INVENTION

The present invention relates to a scroll type compressor which compresses introduced fluid by moving fluid pockets formed between a fixed scroll and a movable scroll while changing their volumes.

In general, a scroll type compressor includes a fixed scroll and a movable scroll which form fluid pockets therebetween to introduce a fluid such as a refrigerant therein. The scroll type compressor further includes a driving mechanism connected to the movable scroll and a main shaft which is connected an electromagnetic clutch unit known in the art. When the main shaft is rotated with the electromagnetic clutch unit being set on, the driving mechanism causes a circular orbital motion of the movable scroll in the manner known in the art. The orbital motion of the movable scroll causes the fluid pockets to move and change their volumes to thereby compress the fluid.

At a moment when started, the scroll type compressor has a starting torque upon operation of the electromagnetic clutch. In a case where the scroll type compressor is installed in an automobile, the starting torque gives a discomfortable shock to a driver. This is because the starting torque is relatively large.

In view of this disadvantage, there has been available a compressor with a soft start mechanism, wherein a soft start can be carried out to reduce the starting torque using the soft start mechanism. An example of the compressor with the soft start mechanism is described in detail in Japanese Second (examined) Patent Publication No. 1-52592 and will later be discussed in conjunction with the drawing.

In the conventional compressor, however, the condition for carrying out the soft start is limited with respect to the compressor speed and the ambient temperature. When the operating pressure is set high, there is a problem that, when the compressor speed is low or the ambient temperature is low, the pressure in a discharge chamber increases so slowly that the take-in volume can not be obtained sufficiently. On the other hand, when the operating pressure is set low, there is a problem that when the compressor speed is high or the ambient temperature is high, the pressure in the discharge chamber increases so quickly that the take-in volume becomes sufficient at once and thus the soft start effect can not be expected.

SUMMARY OF THE INVENTION

It is therefore an object of the present invention to provide a scroll type compressor which enables the soft start with a simple structure.

It is another object of the present invention to provide a scroll type compressor which can reliably carry out the soft start over wider ranges of the compressor speeds and the ambient temperatures upon starting an electromagnetic clutch unit.

It is still another object of the present invention to provide a scroll type compressor which can reduce a shock caused by the starting torque upon starting an electromagnetic clutch unit so as to improve the driveability.

A scroll type compressor to which the present invention is applicable comprises a compressor housing defining a suction chamber and a discharge chamber, a fixed scroll fixedly placed in the compressor housing, a movable scroll movably placed in the compressor housing, and a driving mechanism for making the movable scroll cause an orbital motion. The fixed scroll comprises a fixed plate member and a fixed spiral member fixed to the fixed plate member. The movable scroll comprises a movable plate member opposite to the fixed plate member in an axial direction and a movable spiral member fixed to the movable plate member to face the fixed spiral member in a radial direction perpendicular to the axial direction. The fixed and the movable spiral members define a plurality of fluid pockets therebetween. Each of the fluid pockets moves from an outer position of the fixed scroll towards an inner position thereof along the fixed spiral member during the orbital motion to communicate with the discharge chamber at the inner position.

According to a first aspect of the present invention, the compressor further comprises a first communication hole made in the fixed plate member for communicating one of the fluid pockets with the suction chamber when the one of the fluid pockets is at a first particular position which is between the outer and the inner positions, a first valve mechanism coupled to the first communication hole and having a first operating pressure for opening or closing the first communication hole with reference to the first operating pressure in response to the first operating pressure and a differential pressure which is between the suction chamber and the discharge chamber, a second communication hole made in the fixed plate member for communicating another of the fluid pockets with the suction chamber when the another of the fluid pockets is at a second particular position which is between the outer and the inner positions and is different from the first particular position, and a second valve mechanism coupled to the second communication hole and having a second reference pressure for opening or closing the second communication hole with reference to the second operating pressure in response to the differential pressure.

According to a second aspect of the present invention, the compressor further comprises a first communication control mechanism coupled to the fixed plate member for controlling communication between one of the fluid pockets and the suction chamber in response to differential pressure between the suction chamber and the discharge chamber and a second communication control mechanism coupled to the fixed plate member for controlling communication between another of the fluid pockets and the suction chamber in response to differential pressure between the suction chamber and said discharge chamber.

According to a third aspect of the present invention, the compressor further comprises a plurality of communication holes made in the fixed plate member for allowing the gas in the fluid pockets to escape at different positions along the fixed spiral member and a plurality of valve mechanisms each corresponding to one of the communication holes for opening or closing the corresponding communication hole, the valve mechanisms having operating pressures which are set different from each other.

DESCRIPTION OF THE PREFERRED EMBODIMENT

Figure 1:
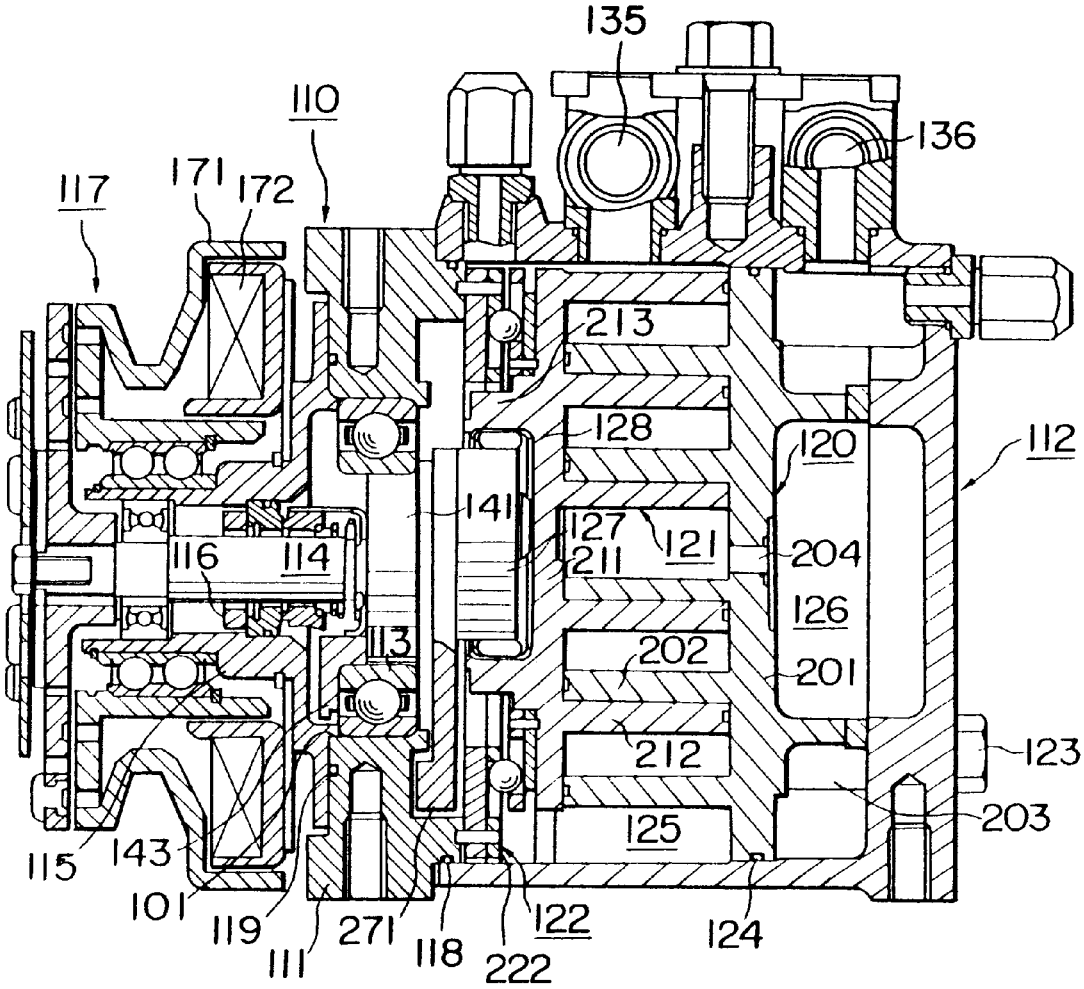
FIG. 1 PRIOR ART
FIG. 1 is a sectional view showing a conventional scroll type compressor.
Figure 2:
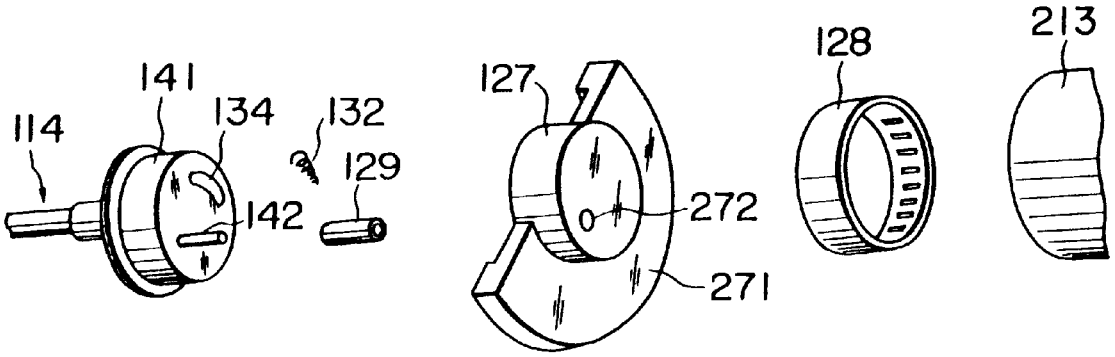
FIG. 2 PRIOR ART
FIG. 2 is a perspective view showing a driving mechanism for a movable scroll shown in FIG. 1, wherein the driving mechanism is shown in a disassembled state.
Figure 3:
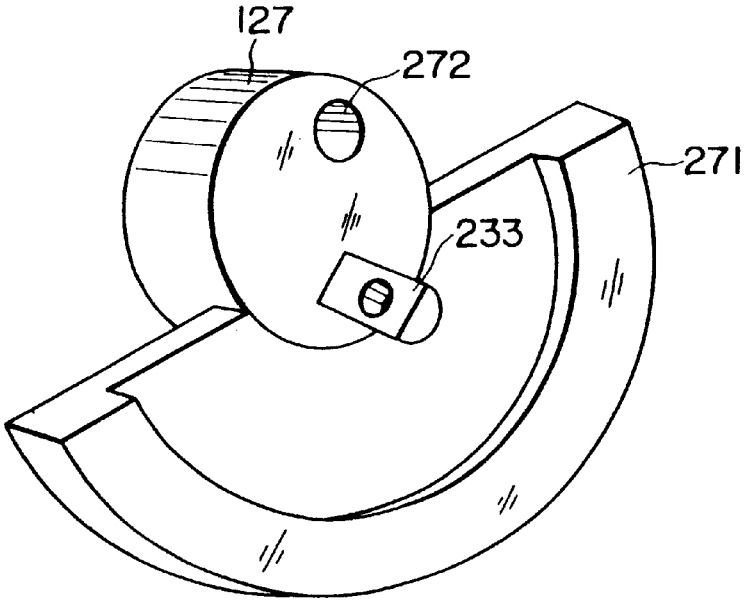
FIG. 3 PRIOR ART
FIG. 3 is a perspective view showing a balance weight, shown in FIGS. 1 and 2, on an enlarged scale.

Referring to FIGS. 1–3, a conventional scroll type compressor will be described at first for a better understanding of the present invention. The conventional scroll type compressor corresponds to a scroll type compressor described in the Japanese Second (examined) Patent Publication No. 1-52592.

The shown compressor comprises a compressor housing 110 having a front end plate 111 and a cup-shaped casing 112 fixed thereto. The front end plate 111 has at the center thereof a through hole 101 with its center located on the center line of the compressor housing 110. A main shaft 114 is rotatably supported at the through hole 101 via a ball bearing 113 so that an axis of the main shaft 114 coincides with the center line of the compressor housing 110.

The front end plate 111 has a sleeve 115 extending forward and encircling the main shaft 114. A shaft seal unit 116 is disposed on the main shaft 114 in the sleeve 115 for sealing purpose. On the outer periphery of the sleeve 115, an electromagnetic clutch unit 117 is disposed. The rotation of an external driving source is transmitted to a pulley 171 via a V-belt (not shown). By controlling energization to an exciting coil 172, the electromagnetic clutch unit 117 controls transmission of the rotation from the pulley 171 to the main shaft 114.

The front end plate 111 has at its rear end an annular projection 142 projecting axially. An inner periphery of an open end of the cup-shaped casing 112 is fitted over an outer periphery of the projection 142, and an O-ring 118 is provided on the outer periphery of the projection 142 for sealing therebetween. The cup-shaped casing 112 is fixed to the front end plate 111 by means of bolts (not shown). In this embodiment, the sleeve 115 is formed separate from the front end plate 111 and fixed thereto by means of bolts (not shown), and an O-ring 119 is provided for sealing therebetween.

In the cup-shaped casing 112 whose open end is closed by the front end plate 111, a fixed scroll 120, a movable scroll 121 and a movable scroll driving mechanism/rotation inhibiting mechanism 122 are disposed.

The fixed scroll 120 comprises an end plate 201, a spiral member 202 formed on the end plate 201 at one side thereof, and a leg portion 203 formed on the end plate 201 at the other side thereof. The fixed scroll 120 is fixed in the cup-shaped casing 112 such that the leg portion 203 is in contact with a bottom 121 of the cup-shaped casing 112 and a bolt 123 is screwed into the leg portion 203 through the bottom 121 from the exterior thereof.

An O-ring 124 is disposed on an outer periphery of the end plate 201 for sealing between it and an inner periphery of the cup-shaped casing 112 so as to define a suction chamber 125 and a discharge chamber 126 in the cup-shaped casing 112. Further, the end plate 201 is formed at its center with a discharge hole 204 for establishing communication between a high-pressure sealed space formed at the center of the movable scroll 121 and the discharge chamber 126.

The movable scroll 121 comprises an end plate 211 arranged at a side of the suction chamber 125, and a spiral member 212 formed on the end plate 211 at one side thereof. The spiral member 212 of the movable scroll 121 is interfitted or mated with the spiral member 202 of the fixed scroll 120 with a phase deviation of 180 degrees and with the center of the spiral member 212 of the movable scroll 121 spacing a given distance from the center of the spiral member 202 of the fixed scroll 120. With this arrangement, line contact portions are formed between the spiral members 202 and 212 so that sealed spaces can be formed.

The main shaft 114 extending through the through hole 101 of the front end plate 111 has a large-diameter portion 141 at its inner end. The large-diameter portion 141 forms a part of the main shaft 114 and is supported by the front end plate 111 via the ball bearing 113 disposed at the through hole 101. A drive pin 142 is fixed to a rear end surface (right end surface in the figure) of the large-diameter portion 141 at a position offset from the axis of the main shaft 114 and projects in the axial direction of the main shaft 114.

Figure 7:
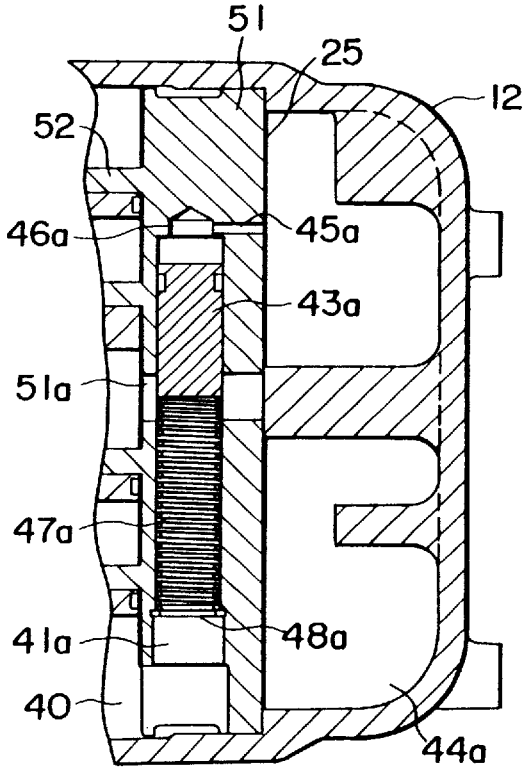
FIG. 7 is a sectional view for explaining the relationship between the bypass hole and the piston valve mechanism in the scroll type compressor shown in FIG. 4, wherein a piston valve is moving from the state shown in FIG. 4.

Further, as shown in FIG. 7, a concave portion 134 is formed on the rear end surface of the large-diameter portion 141 so as to be arc-shaped with respect to the drive pin 142. The circumferential length of the concave portion 134 is set to a predetermined value.

On the other hand, an annular boss 213 is provided on the end plate 211 of the movable scroll 121 at a side thereof opposite to the side where the spiral member 212 is provided. A disc-shaped eccentric bushing 127 is received in the boss 213 and rotatably supported via a needle bearing 128. The bushing 127 is integrally provided with a semidisc-shaped balance weight 271 extending in radial directions of the bushing 127. The bushing 127 is formed with an eccentric axial hole 272 at a position offset from the center thereof.

Figure 8:
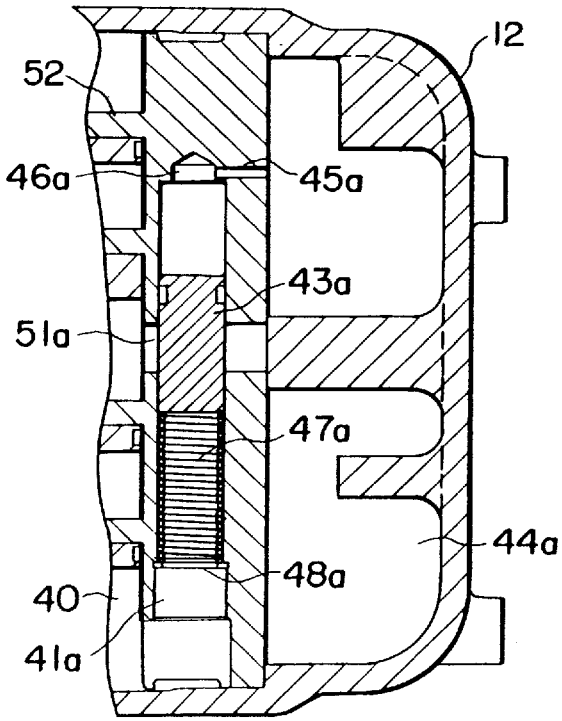
FIG. 8 is a sectional view for explaining the relationship between the bypass hole and the piston valve mechanism in the scroll type compressor shown in FIG. 4, wherein the piston valve has moved from the state shown in FIG. 7 to close the bypass hole.

As shown in FIG. 8, the bushing 127 is further provided on a side thereof confronting the large-diameter portion 141 with a convex portion 233. The drive pin 142 is received in the eccentric axial hole 272 via a needle bearing 129 so that the bushing 127 is supported rotatably relative to the large-diameter portion 141, i.e. the main shaft 114, and eccentrically relative to the axis of the main shaft 114. The convex portion 233 is inserted into the concave portion 134 with a given gap in which a spring 132 is disposed.

The movable scroll 121 is coupled to the movable scroll driving mechanism/rotation inhibiting mechanism 122 so as to make an orbital motion on a given circular orbit following the rotation of the main shaft 114. The orbital motion of the movable scroll 121 causes the line contact portions formed between the spiral members 202 and 212 to move along the surfaces of the spiral members 202 and 212 so that the fluid is compressed.

Accordingly, the fluid flowing into the suction chamber 125 in the compressor housing 110 from an external fluid circuit via a suction port 135 provided on the outer periphery of the compressor housing 110 is introduced into fluid pockets through the outer ends of the spiral members 202 and 212 and then the compressed fluid is forced out into the discharge chamber 126 from a fluid pocket at the centers of the spiral members 202 and 212. Thereafter, the compressed fluid is discharged to the external fluid circuit from the discharge chamber 126 via a discharge port 136 provided on the outer periphery of the compressor housing 110.

By driving the movable scroll 121 using the bushing 127, pressing forces at the line contact portions between the spiral members 202 and 212 are automatically obtained due to the reaction of the fluid compression so that sealing of the fluid pockets is ensured.

Since centrifugal forces are added due to the orbital motions of the movable scroll 121, the bearing 128 and the bushing 127, the pressing forces become large. As a result, frictional forces between the spiral members 202 and 212 increase. Therefore, the balance weight 271 is provided so as to cancel the centrifugal forces caused by the orbital motions of the movable scroll 121, the bearing 128 and the bushing 127, using a centrifugal force of the balance weight 271. Accordingly, the adequate sealing can be obtained with less abrasion of the spiral members 202 and 212 so as to enable the smooth orbital motion of the movable scroll 121.

By setting an unbalance amount Uos (g-cm) of the orbiting portion including the movable scroll 121 and the ball-coupling movable portions and an unbalance amount Ucw (g-cm) of the counter weight attached to the bushing to be equal to each other, the centrifugal forces generated by the orbiting portions are canceled by the centrifugal force generated by the counter weight.

It is assumed that:

$$Uos > Ucw$$

and $$Uos - Ucw = \Delta U.$$

In this case, a pressing force F (kgf) of the spring 132 is set equal to a combined force of a combined force at a preset compressor speed (i.e. gas compression force) and a centrifugal force determined by ΔU. Specifically, the pressing force F of the spring is given by:

$$\Delta\omega^2/g = F,$$

wherein ω represents a shaft angular velocity at a preset speed.

For example, assuming that a preset speed is 1500 rpm, the pressing force F is given by:

$$F = 200 \cdot (50\pi)^2/980 = 5036(\text{gf}).$$

Accordingly, if a spring of about 5 kgf is used, until the speed of the main shaft reaches 1500 rpm from the start thereof, the bushing 127 does not rotate about the drive pin 142 so that sufficient gaps are provided between the spiral members 202 and 212 and thus almost no compression is carried out. On the other hand, if the speed of the main shaft exceeds 1500 rpm, even slightly, then a centrifugal force overcomes to cause the bushing 127 to rotate about the drive pin 142 so that a required orbiting radius, where the spiral members 202 and 212 can abut each other, is reached to allow the compression to be started. That is, the compression is not carried out until the compressor exceeds the given speed from the start thereof.

This means that the shown compressor has a soft start mechanism in which a soft start can be carried out to reduce a starting torque known in the art. Then, when the compression is started, the spring 132 corresponds to the gas compression force so that excellent sealing is achieved between the fixed and movable scrolls.

Now, description will be made as regards a scroll type compressor according to a preferred embodiment of the present invention.

Figure 4:
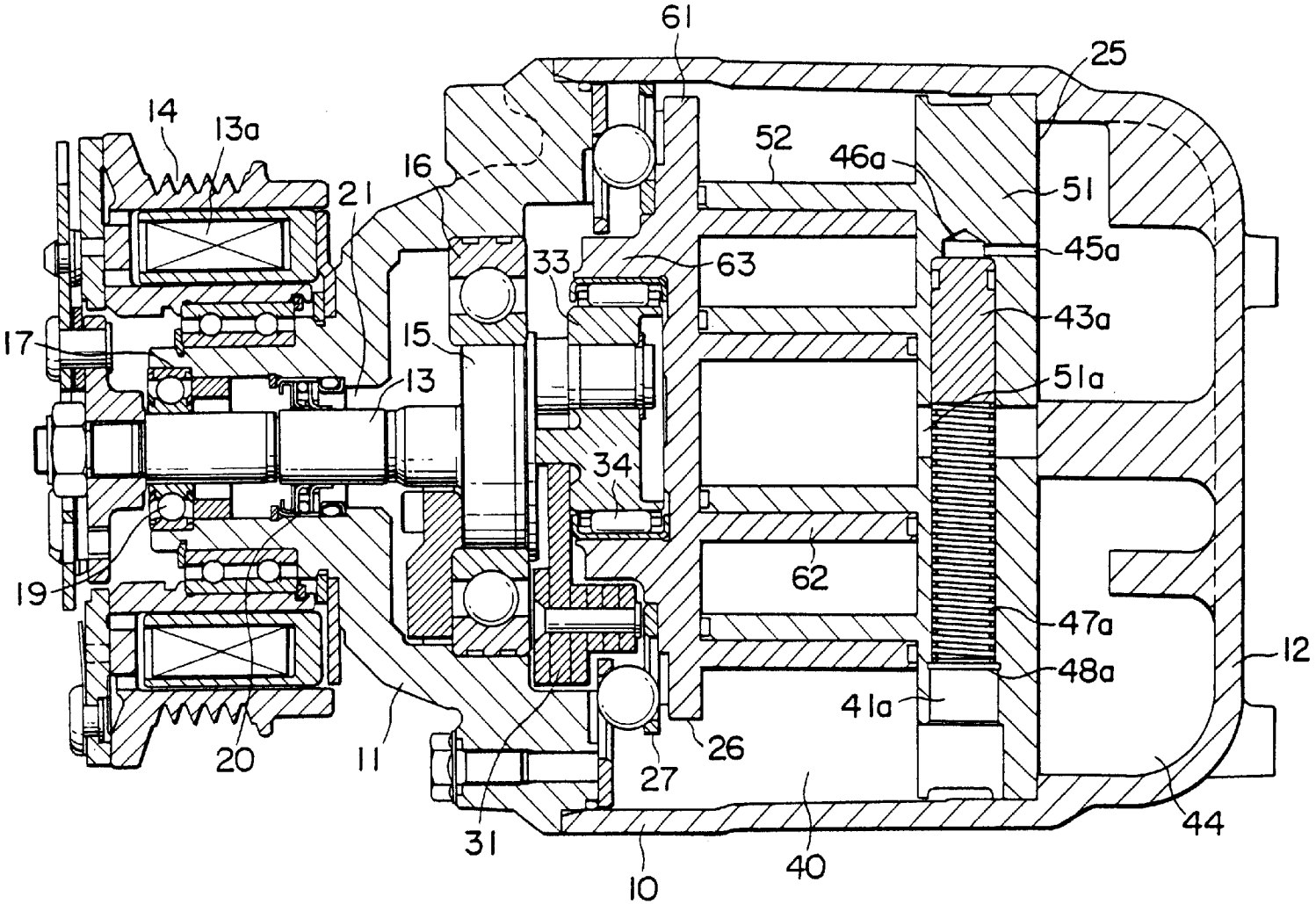
FIG. 4 is a sectional view showing a scroll type compressor according to a preferred embodiment of the present invention.

Referring to FIG. 4, the compressor comprises a compressor housing 10. The compressor housing 10 comprises a front end plate (front housing) 11 and a cup-shaped casing (rear casing) 12 attached thereto. The front end plate 11 is formed at the center thereof with a through hole 21 for receiving a main shaft 13 therethrough. The main shaft 13 extends in an axial direction and is formed with a large-diameter portion 15 at its axially inner end. The large-diameter portion 15 is rotatably supported by the front end plate 11 via a ball bearing 16 interposed therebetween. A disc-shaped eccentric bushing 33 is mounted to the large-diameter portion 15 so as to be eccentric relative to the main shaft 13.

The front end plate 11 has a sleeve 17 extending forward and encircling the main shaft 13. A ball bearing 19 is disposed in the sleeve 17 at a front end thereof so as to rotatably support the main shaft 13.

A shaft seal unit 20 is disposed on the main shaft 13 in the through hole 21. The rotation of an external driving source, such as an automobile engine, is transmitted to the main shaft 13 via an electromagnetic clutch 14.

In the cup-shaped casing 12, a fixed scroll 25, a movable scroll 26 and a rotation inhibiting mechanism 27 are disposed. The fixed scroll 25 includes a fixed plate member (bottom plate) 51 and a first spiral member 52 fixed to the fixed plate member 51 at one side thereof. The fixed plate member 51 is fixed to the cup-shaped casing 12. The movable scroll 26 includes a movable plate member (bottom plate) 61 and a second spiral member 62 fixed to the movable plate member 61 at one side thereof. The movable plate member 61 is opposite to the fixed plate member 51 in the axial direction. The second spiral member 62 faces the first spiral member 51 in a radial direction perpendicular to the axial direction. An annular boss 63 is provided on the movable plate member 61 on a side thereof opposite to the side where the second spiral element 62 is provided. The bushing 33 is received in the boss 63 and rotatably supported via a needle bearing 34. The bushing 33 is integrally provided with a semidisc-shaped balance weight 31 extending in radial directions of the bushing 33.

The second spiral member 62 is interfitted or mated with the first spiral member 52 with a phase deviation of 180 degrees so as to define fluid pockets therebetween. The movable scroll 26 is coupled to the rotation inhibiting mechanism 27 so as to be prevented from rotation on its axis. On the other hand, the movable scroll 26 makes an orbital motion on a given circular orbit depending on the rotation of the main shaft 13. The orbital motion of the movable scroll 26 causes the fluid pockets to move from an outer position of the fixed scroll 25 toward an inner portion or the center of the fixed scroll 25 while changing their volumes so as to compress the refrigerant gas introduced into the fluid pockets via a suction chamber 40. The compressed refrigerant is then discharged into a discharge chamber 44 through a discharge hole 53 (see FIGS. 2 and 3) formed at the center of the fixed plate member 51. A combination of the large-diameter portion 15, the disc-shaped eccentric bushing 33, the boss 63, and the rotation inhibiting mechanism 27 is referred to as a driving mechanism which is for making the movable scroll 26 cause an orbital motion known in the art.

As shown in FIG. 4, the fixed plate member 51 of the fixed scroll 25 is formed with a bypass hole 51*a*. The fixed plate member 51 is further formed with a cylinder 41*a* extending along a radial plane perpendicular to the axial direction. The cylinder 41*a* has a first and a second end portions communicated with the suction chamber 40 and the discharge chamber 44, respectively. A combination of the bypass hole 51*a* and the cylinder 41*a* is referred to as a first communication hole which is for communicating one of the fluid pockets with the suction chamber 40 when the one of the fluid pockets is at a first particular position which is between the outer and the inner positions of the fixed scroll 25.

A piston valve 43*a* is slidably disposed in the cylinder 41*a* to be movable along the cylinder 41*a* between a first position at which the piston valve 43*a* closes the bypass hole 51*a* and a second position at which the piston valve 43*a* opens the bypass hole 51*b* so as to communicate with the suction chamber 40 through the cylinder 41*a*. Specifically, as shown in the figure, one end (lower end) of the cylinder 41*a* communicates with the suction chamber 40, and a hollow piston stopper 48*a* is fixed in the cylinder 41*a*. One end of a spring 47*a* is fixed to the piston stopper 48*a*, while the piston valve 43*a* is fixed to the other end of the spring 47*a*. Thus, the piston valve 43*a* is supported by the spring 47*a* so as to be biased upward. A combination of the cylinder 41*a*, the piston stopper 48*a*, the spring 47*a*, and the piston valve 43*a* is referred to as a first valve mechanism. A combination of the first valve mechanism and the bypass hole 51 may be referred to as a first communication control mechanism.

The fixed plate member 51 of the fixed scroll 25 is further formed with a back pressure chamber 46*a* confronting an upper end surface of the piston valve 43*a*, and a discharge gas guide hole 45*a* establishing communication between the back pressure chamber 46*a* and the discharge chamber 44.

Accordingly, the pressure in the discharge chamber 44 is applied to the upper end surface of the piston valve 43*a*. Thus, the piston valve 43*a* moves depending on a difference between the biasing force of the spring 47*a* and the pressure in the discharge chamber 44 so as to open or close the bypass hole 51*a*. That is, by controlling the pressure in the discharge chamber 44, the movement of the piston valve 43*a* is controlled to open or close the bypass hole 51*a* so that the displacement of the compressor is varied.

Figure 5:
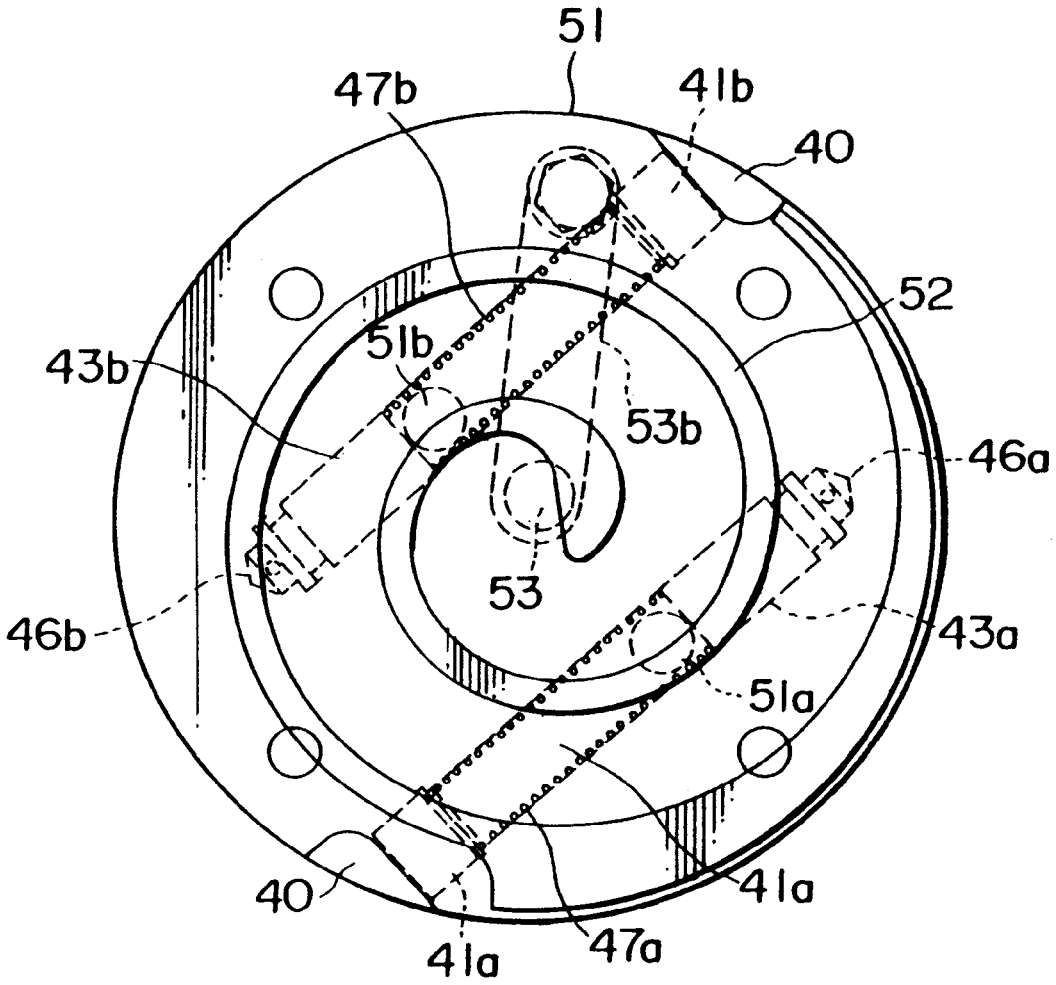
FIG. 5 is a left-side view, as seeing a fixed scroll from the left side in FIG. 4, for explaining a relationship between bypass holes and corresponding piston valve mechanisms in the scroll type compressor shown in FIG. 4.
Figure 6:
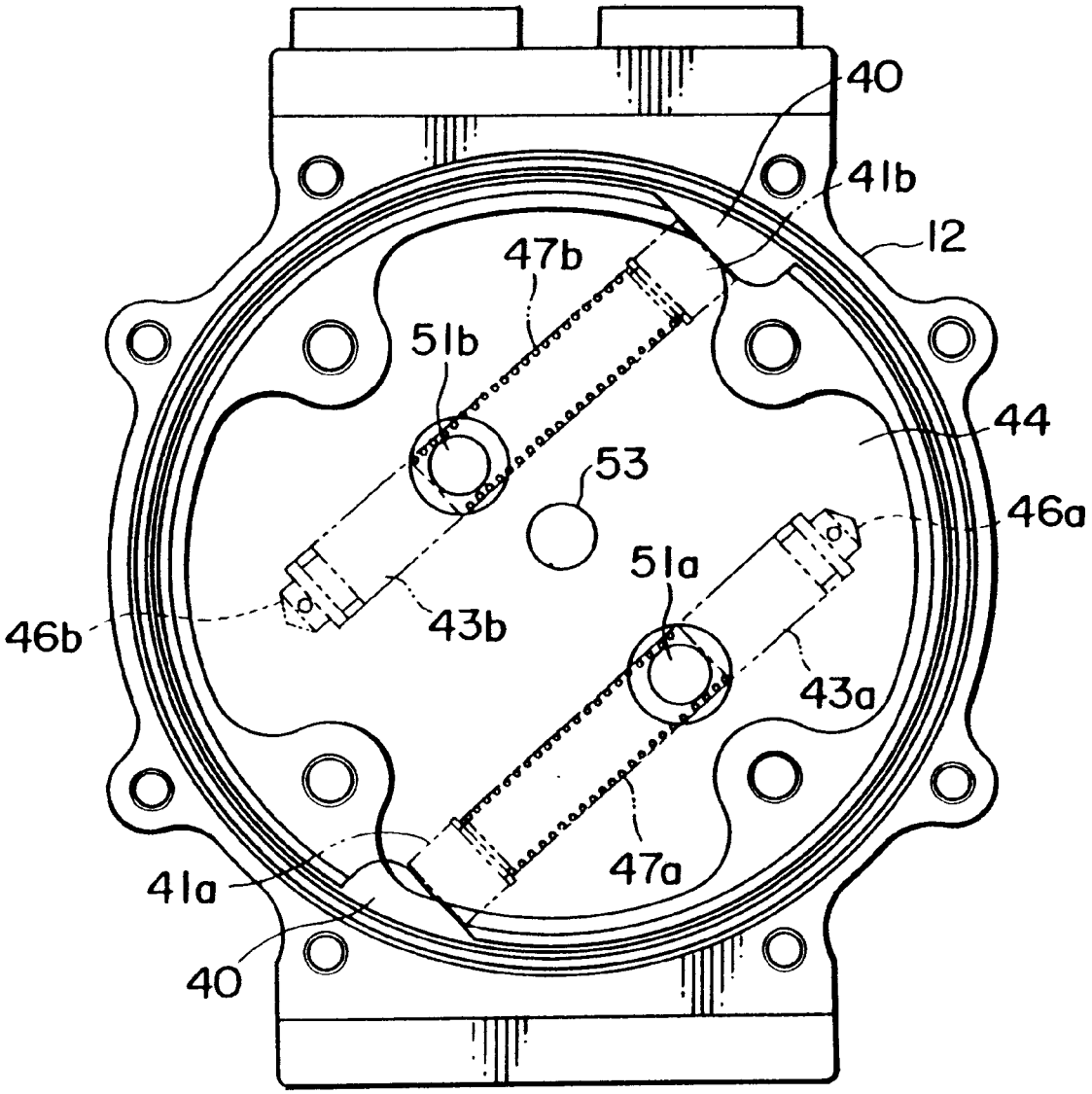
FIG. 6 is a left-side view, as seeing a casing from the left side in FIG. 4, for explaining the relationship between the bypass holes and the corresponding piston valve mechanisms in the scroll type compressor shown in FIG. 4.

As shown in FIGS. 5 and 6, the fixed plate member 51 of the fixed scroll 25 is formed with a further bypass hole 51*b* and a corresponding valve mechanism comprising a cylinder 41*b*, a piston valve 43*b*, a piston stopper 48*b*, and a spring 47*b*. The cylinder 41*b* extends along the above-mentioned radial plane to have a first and a second end portions communicated with the suction chamber 40 and the discharge chamber 44, respectively. The piston valve 43*b* is inserted in the cylinder 41*b* to be movable along the cylinder 41*b* between a first position at which the piston valve 43*b* closes the bypass hole 51*b* and a second position at which the piston valve 43*b* opens the bypass hole 51*b* so as to communicate with the suction chamber 40 through the cylinder 41*b*. The piston stopper 48 is fixedly placed in the cylinder 41*b*. The spring 47*b* is interposed between the piston valve 43*b* and the piston stopper 48 for urging the piston valve 43*b* towards the second position.

Further, the fixed plate member 51 is formed with a back pressure chamber 46*b* confronting an upper end surface of the piston valve 43*b*, and a discharge gas guide hole 45*b* establishing communication between the back pressure chamber 46*b* and the discharge chamber 44. A combination of the bypass hole 51*b* and the cylinder 41*b* is referred to as a second communication hole which is for communicating another of the fluid pockets with the suction chamber 40 when the another of the fluid pockets is at a second particular position which is between the outer and the inner positions of the fixed scroll 25 and is different from the first particular position. A combination of the cylinder 41*b*, the piston stopper 48*b*, the spring 47*b*, and the piston valve 43*b* is referred to as a second valve mechanism. A combination of the second valve mechanism and the bypass hole 51*b* may be referred to as a second communication control mechanism.

The first and the second valve mechanisms have a first and a second operating pressures for the bypass holes 51*a* and 51*b*, respectively. The first and the second operating pressures are set different from each other, i.e. the biasing forces of the springs 47*a* and 47*b* are set different from each other.

The fixed plate member 51 is formed at the center thereof with the discharge hole 53 as mentioned before and provided with a discharge valve 53*b* for opening and closing the discharge hole 53.

As described above, the discharge chamber 44 communicates with the back pressure chambers 46*a* and 46*b*, and the cylinders 41*a* and 41*b* communicate with the suction chamber 40. As further described above, the pressure in the discharge chamber 44 is adjusted to control the operations of the piston valve mechanisms so that the bypass holes 51*a* and 51*b* are open/close controlled, respectively.

Now, referring to FIGS. 4, 7 and 8, an operation of the scroll type compressor in this embodiment will be described.

In the state shown in FIG. 1, the electromagnetic clutch unit 14 has been just started and the bypass hole 51*a* (51*b*) is open. In the state shown in FIG. 7, the pressure in the discharge chamber 44 has started to increase so that the discharge gas has entered the back pressure chamber 46*a* (46*b*) via the discharge gas guide hole 45*a* (45*b*) to move the piston valve 43*a* (43*b*). In the state shown in FIG. 5, the piston valve 43*a* (43*b*) has moved to close the bypass hole 51*a* (51*b*) so that the take-in volume is fully satisfied.

Upon the start-up of the compressor, the pressure in the discharge chamber 44 is low so that, as shown in FIG. 4, the piston valve 43*a* is pressed against an upper end of the cylinder 41*a* (41*b*) due to the biasing force of the spring 47*a* (47*b*). In this state, the bypass hole 51*a* (51*b*) is opened.

Accordingly, the gas introduced via the outer end of the first spiral member 52 shown in FIGS. 2 and 3 flows into the suction chamber 40 via the bypass hole 51*a* (51*b*), bypassing the subsequent spiral path located inward of the bypass hole 51*a* (51*b*), so that the starting torque is reduced. Then, as the gas is compressed in the subsequent spiral path to gradually increase the pressure in the discharge chamber 44, the piston valve 43*a* (43*b*) moves in a direction to close the bypass hole 51*a* (51*b*) as shown in FIG. 7, so that the take-in volume becomes sufficient. In this event, since the operating pressures of the pair of piston valve mechanisms are set different from each other as described above, the bypass holes 51*a* and 51*b* are closed in turn as shown in FIG. 5 so that the torque increase can be gradual and further the ranges of the compressor speeds and the ambient temperatures for carrying out the soft start can be widened.

Specifically, the operating pressure of one of the pair of piston valves 43*a* and 43*b* is set low so that the take-in volume tends to be sufficient even when the compressor speed or the ambient temperature is low, and the operating pressure of the other piston valve is set high so as to avoid the rapid increase of the take-in volume to achieve the soft start when the compressor speed or the ambient temperature is high.

Further, since it is not necessary to set a diameter of each of the cylinders of the piston valve mechanisms to be large, the compressor is not increased in size. Thus, the compressor can be small in size to reliably reduce the starting torque shock.

While this invention has thus been described in conjunction with a single embodiment thereof, it will readily be possible for those skilled in the art to put this invention into practice in various other manners. For example, three or more communication control mechanisms may be provided in the fixed scroll.

What is claimed is:

1. A scroll type compressor comprising a compressor housing defining a suction chamber and a discharge chamber, a fixed scroll fixedly placed in said compressor housing, a movable scroll movably placed in said compressor housing, and a driving mechanism for making said movable scroll cause an orbital motion, said fixed scroll comprising a fixed plate member and a fixed spiral member fixed to said fixed plate member, said movable scroll comprising a movable plate member opposite to said fixed plate member in an axial direction and a movable spiral member fixed to said movable plate member to face said fixed spiral member in a radial direction perpendicular to said axial direction, said fixed and said movable spiral members defining a plurality of fluid pockets therebetween, each of said fluid pockets moving from an outer position of said fixed scroll towards an inner position thereof along said fixed spiral member during said orbital motion to communicate with said discharge chamber at said inner position, said compressor further comprising:

a first communication hole made in said fixed plate member for communicating one of said fluid pockets with said suction chamber when said one of the fluid pockets is at a first particular position which is between said outer and said inner positions;

a first valve mechanism coupled to said first communication hole and having a first operating pressure for opening or closing said first communication hole with reference to said first operating pressure in response to a differential pressure which is between said suction chamber and said discharge chamber;

a second communication hole made in said fixed plate member for communicating another of said fluid pockets with said suction chamber when said another of the fluid pockets is at a second particular position which is between said outer and said inner positions and is different from said first particular position; and a second valve mechanism coupled to said second communication hole and having a second operating pressure for opening or closing said second communication hole with reference to said second operating pressure in response to said differential pressure, said second operating pressure being different from said first operating pressure.

2. A scroll type compressor as claimed in claim 1, wherein said first valve mechanism comprises:

a first cylinder portion extending from said first communication hole to said discharge chamber in said fixed plate member; and a first piston valve disposed in said first cylinder portion and movable along said fist cylinder portion to open or close said first communication hole in response to said differential pressure;

said second valve mechanism comprising:

a second cylinder portion extending from said second communication hole to said discharge chamber in said fixed plate member; and a second piston valve disposed in said second cylinder portion and movable along said second cylinder portion to open or close said second communication hole in response to said differential pressure.

3. A scroll type compressor as claimed in claim 2, wherein said first valve mechanism further comprises a first spring for determining said first operating pressure, said first spring urging said first piston valve with a first biasing force to open said first communication hole, said second valve mechanism further comprising a second spring for determining said first operating pressure, said second spring urging said second piston valve with a second biasing force to open said second communication hole.

4. A scroll type compressor as claimed in claim 3, wherein said first and said second biasing forces are determined different from each other.

5. A scroll type compressor as claimed in claim 2, further comprising:

a discharge hole made in said fixed plate member for communicating one of said fluid pockets with said discharge chamber when said one of the fluid pockets is at said inner position; and a discharge valve placed between said discharge hole and said discharge chamber for opening or closing said discharge hole, pressure of said discharge chamber being supplied to each of said first and second cylinder portions.

6. A scroll type compressor as claimed in claim 3, wherein said first and second valve mechanisms further comprise a first and a second piston stopper fixedly placed in said first and said second cylinder portions, respectively, each of said first and second cylinder portions extending along a plane perpendicular to said axial direction, said first spring being placed in said first cylinder portion and interposed between said first piston valve and said first piston stopper, said second spring being placed in said second cylinder portion and interposed between said second piston valve and said second piston stopper.

7. A scroll type compressor comprising a compressor housing defining a suction chamber and a discharge chamber, a fixed scroll fixedly placed in said compressor housing, a movable scroll movably placed in said compressor housing, and a driving mechanism for making said movable scroll cause an orbital motion, said fixed scroll comprising a fixed plate member and a fixed spiral member fixed to said fixed plate member, said movable scroll comprising a movable plate member opposite to said fixed plate member in an axial direction and a movable spiral member fixed to said movable plate member to face said fixed spiral member in a radial direction perpendicular to said axial direction, said fixed and said movable spiral members defining a plurality of fluid pockets therebetween, each of said fluid pockets moving from an outer position of said fixed scroll towards an inner position thereof along said fixed spiral member during said orbital motion to communicate with said discharge chamber at said inner position, said compressor further comprising:

a plurality of communication holes made in said fixed plate member for allowing the gas in said fluid pockets to escape at different positions along said fixed spiral member; and a plurality of valve mechanisms each corresponding to one of said communication holes for opening or closing the corresponding communication hole, said valve mechanisms having operating pressures which are set different from each other.

8. A scroll type compressor as claimed in claim 7, wherein each of said valve mechanisms comprises:

a cylinder formed in said first plate member and having one end communicating with said suction chamber;

a piston stopper fixed in said cylinder;

a piston valve slidably disposed in said cylinder; and a spring having one end fixed to said piston stopper and the other end fixed to said piston valve, said first plate member being further formed with a discharge gas guide hole establishing communication between said discharge chamber and the other end of said cylinder.

9. A scroll type compressor as claimed in claim 8, wherein said springs having biasing forces which are set different from each other.

* * * * *